United States Patent [19]

Buetemeister et al.

[11] Patent Number: 4,549,089

[45] Date of Patent: Oct. 22, 1985

[54] ENGINE CRANKING MOTOR LOCK OUT SYSTEM

[75] Inventors: Earl H. Buetemeister, Alexandria; Larry L. Colville, Anderson, both of Ind.

[73] Assignee: General Motors Corporation, Detroit, Mich.

[21] Appl. No.: 581,916

[22] Filed: Feb. 21, 1984

[51] Int. Cl.[4] ..... F02N 11/08

[52] U.S. Cl. ..... 290/38 R; 73/35

[58] Field of Search ..... 290/36 R, 36 A, 37 R, 290/38 R, 38 C, 38 E, DIG. 1, DIG. 3, DIG. 11; 73/35

[56] References Cited

U.S. PATENT DOCUMENTS 3,628,041 12/1971 Cummins et al. ..... 290/38 X 4,393,688 7/1983 Johnston et al. ..... 73/35

4,446,722 5/1984 Boruschewitz et al. ..... 73/35

4,483,181 11/1984 Maekawa et al. ..... 73/35

4,491,010 1/1985 Brandt et al. ..... 73/35

*Primary Examiner*—William M. Shoop, Jr.

*Assistant Examiner*—W. E. Duncanson, Jr.

*Attorney, Agent, or Firm*—C. R. Meland

[57] ABSTRACT

Apparatus for sensing a running condition of an internal combustion engine. A bolt which fastens an engine starter to the engine has a head which carries a piezoelectric disk. When the engine is running the head of the bolt is flexed causing flexure of the piezoelectric disk which causes a charge of voltage to be generated by the piezoelectric disk. The piezoelectric disk is connected with an electric starting motor control system which is operative to prevent energization of the starting motor when the engine is running.

7 Claims, 4 Drawing Figures

ENGINE CRANKING MOTOR LOCK OUT SYSTEM

This invention relates to apparatus for detecting the running condition of an internal combustion engine and more particularly to a cranking motor lock out system for preventing a cranking motor, or starter, from cranking the engine when the engine is in the running mode.

Devices for detecting a running condition of an internal combustion engine and for preventing engine cranking by a cranking motor, when the engine is running, are well known to those skilled in the art, one example being the U.S. patent to Cummins et al. U.S. Pat. No. 3,628,041. In that patent a vibration transducer is mounted on either the cranking motor or the engine and when the engine is running the transducer produces an electrical signal that is utilized to prevent energization of the cranking motor.

In contrast to the system disclosed in the above-referenced Cummins et al. patent, the system of this invention detects a running condition of the engine by sensing distortion of the head of a bolt that secures the cranking motor to the engine. The head of the bolt is distorted when the engine is in a running mode and this sensed distortion is utilized as an indication of a running condition of the engine and is used to prevent energization of the cranking motor. More specifically, the bolt that is utilized to secure the cranking motor to the engine has a head portion that carries a piezoelectric disk. When the engine is in a running mode the cranking motor oscillates and causes the head of the bolt to distort thereby flexing the piezoelectric disk. The disk generates a charge or voltage in response to flexure thereof and this charge or voltage is amplified to provide an electrical signal indicative of the fact that the engine is running. This electrical signal is applied to electric circuitry that prevents energization of the cranking motor when the engine is running. It accordingly is an object of this invention to provide apparatus for indicating that an internal combustion engine is running by sensing the distortion of a head of a bolt that secures a cranking motor to the engine. A more specific object of this invention is to provide an arrangement for preventing energization of a cranking motor when the engine is running by detecting the charge or voltage developed by a piezoelectric element that is secured to the head of a bolt that is utilized to fasten the cranking motor to the engine.

Another object of this invention is to provide apparatus of the type described wherein upon initial cranking of the engine the signal developed by the piezoelectric element does not prevent the cranking mode of operation and wherein, upon starting of the engine, the signal developed by the piezoelectric element is rendered capable of preventing energization of the cranking motor.

Another object of this invention is to provide a cranking motor lock out system of the type described that requires electrical power only during the cranking mode of operation.

IN THE DRAWINGS

FIG. 4 is a schematic circuit diagram of a cranking motor lock out system made in accordance with this invention.

Figure 1:
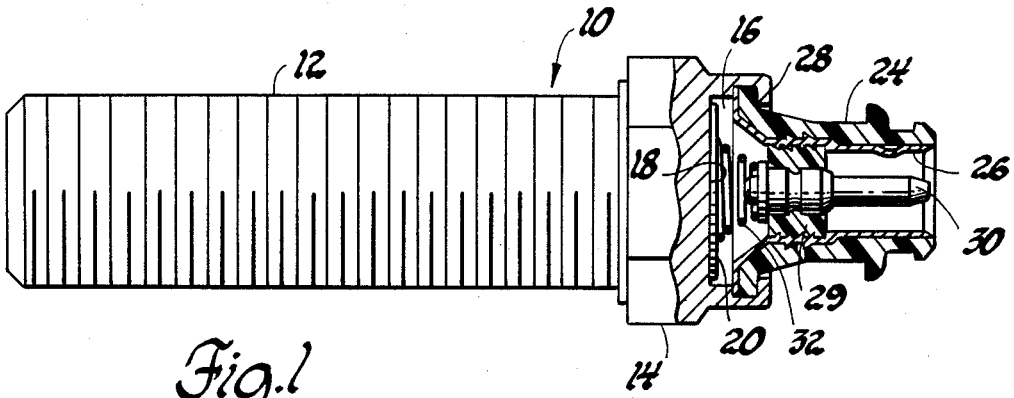
FIG. 1 is a view with parts broken away of a bolt that is utilized to fasten a cranking motor to an internal combustion engine.

Referring now to the drawings and more particularly to FIG. 1, the reference numeral 10 designates a cranking motor mounting bolt that is fitted with a transducer for detecting the running condition of an internal combustion engine. The bolt 10 is formed of steel and has a threaded portion 12 and a hexagonal head portion 14. The head portion 14 has a recess 16 defined in part by an inner annular wall 18. An annular piezoelectric disk, designated by reference numeral 20, is supported by the wall 18. The disk 20 is adhesively secured to the wall 18 by an epoxy composition and the side of the disk that faces the wall 18 is electrically connected thereto by a plurality of ridges (not illustrated) that directly contact the disk 20. The ridges provide areas for the epoxy material which serves to hold the disk fixed to the wall 18. By way of example, the ridges and adhesive may be of the type illustrated in the U.S. patent to Johnston et al. U.S. Pat. No. 4,393,688.

The bolt 10 carries a terminal assembly that is comprised of a tubular part 24 that is formed of insulating material. The insulator 24 is molded to a tubular metal part 26 and these parts are held fixed to the head portion 14 of the bolt 10 by crimping over a portion 28 of the bolt. The terminal assembly further includes a metallic male terminal stud 30 which is fixed to the part 26. Thus, a part 29 that is formed of plastic material, for example a polyester material that has a carbon filler is interposed between the part 26 and stud 30. The part 29 serves as a support for the stud 30 and as an electrical resistor that is connected between parts 26 and 30. The resistance of this resistor may be about 100K to 10 megohms. A metallic spring 32 is compressed between one face of the piezoelectric disk and the end of the terminal stud 30. The spring 32 provides an electrical connection between one face of the piezoelectric disk 20 and the terminal stud 30.

Figure 3:
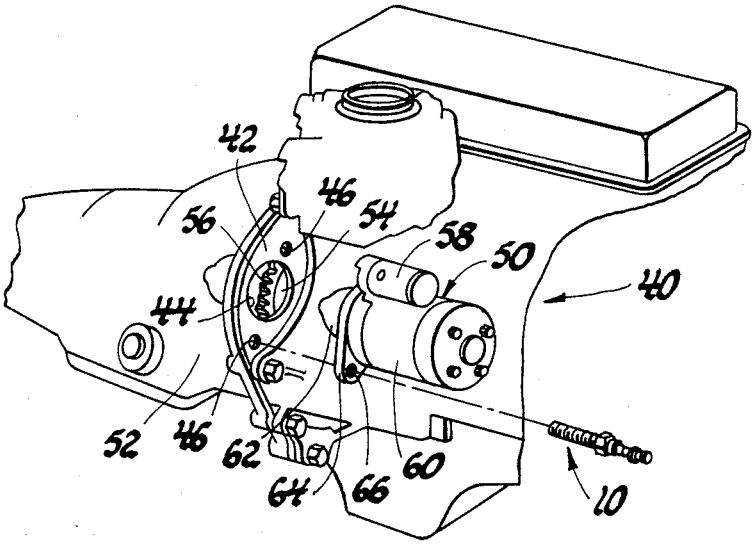
FIG. 3 illustrates an arrangement for mounting a cranking motor to an internal combustion engine that utilizes the bolt illustrated in FIG. 1.
Figure 7:
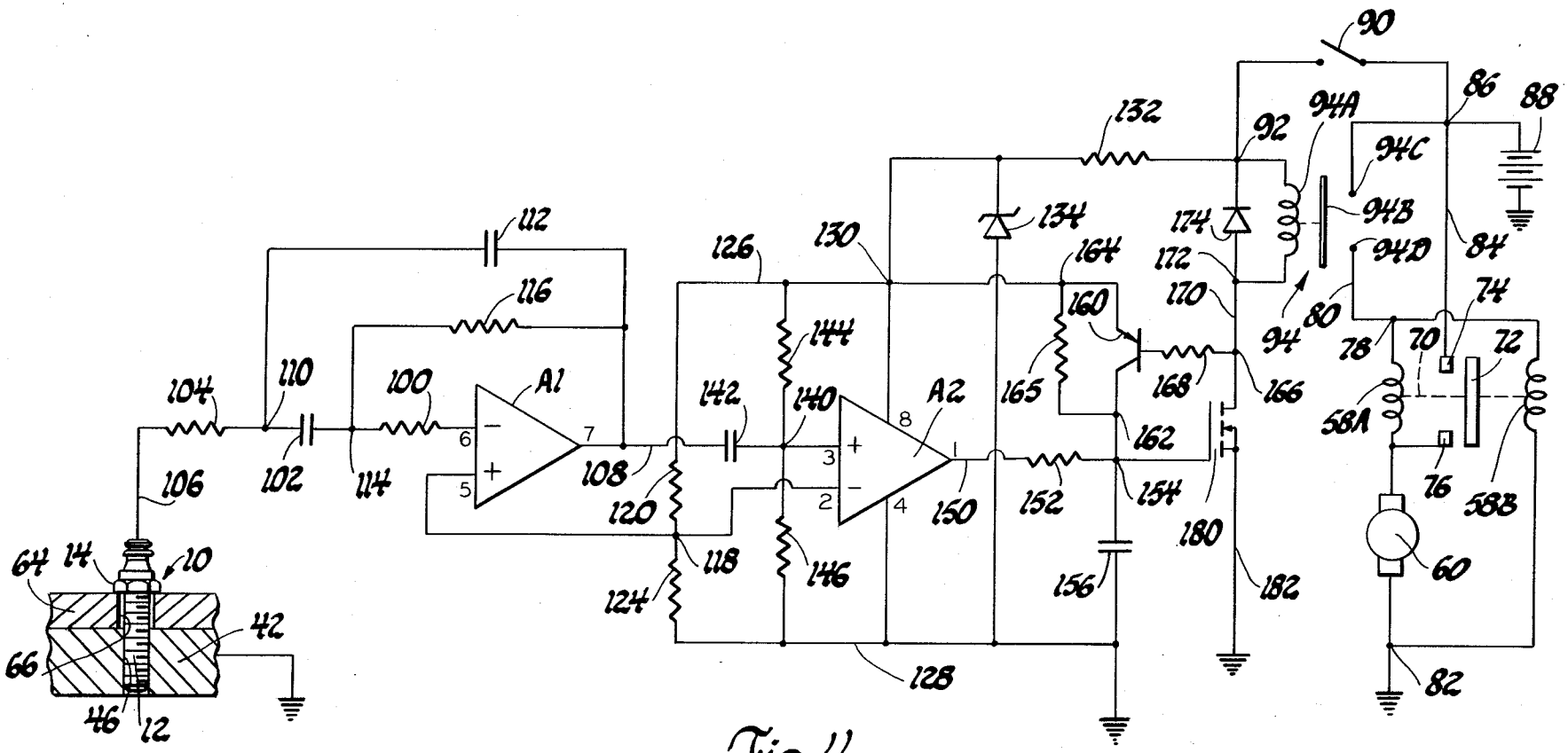

Referring now more particularly to FIG. 3, the arrangement for mounting a starting motor on an internal combustion engine that utilizes the bolt of FIG. 1 is illustrated. In FIG. 3, the reference numeral 40 generally designates an internal combustion engine. The block of the engine is provided with a mounting flange designated by reference numeral 42 which has an opening 44. Disposed about the opening 44 are a plurality of threaded openings 46 which are adapted to receive mounting bolts for securing a cranking motor or electric starter generally designated by reference numeral 50 to the engine 40. The reference numeral 52 designates a flywheel housing which encloses a flywheel designated by reference numeral 54. The flywheel 54 is secured to the crankshaft of the engine 40 and a ring gear 56 is carried by the flywheel 54. The electric cranking motor or starter 50 is of a conventional construction and comprises a solenoid 58, a direct voltage cranking motor 60 and a drive housing designated by reference numeral 62. The drive housing has a mounting flange 64 provided with a plurality of holes 66 that become aligned with the threaded openings 46 when the cranking motor 50 is attached to the engine mounting plate or flange 42.

The shaft of the cranking motor 50, as is well known to those skilled in the art, carries a pinion (not illustrated) which at times becomes meshed with the ring gear 56 of the engine. The pinion is shifted by a conventional shift lever which is moved when the solenoid 58 is energized. Cranking motors of the type that have been described are well known to those skilled in the art. Examples of such cranking motors are disclosed in the U.S. patents to Antonidis U.S. Pat. No. 2,765,133 and Schneider et al. U.S. Pat. No. 2,862,391.

When the cranking motor or starter 50 is fastened to the engine 40 the end of the housing portion 62 thereof is moved through the opening 44 and a plurality of bolts are inserted though the openings 66 of the mounting flange 64 and are threaded into the threaded openings 46. Assuming that two bolts are utilized to fasten the cranking motor 50 to the engine 40, one of the bolts will be of a conventional construction. The other bolt designated by reference numeral 10 is of the type illustrated in FIG. 1, that is the head of this bolt is provided with the piezoelectric transducer 20.

When the cranking motor has been fastened to the plate or flange 42 of the engine 40 it can be seen that it is mounted in a cantilever fashion, that is it extends axially from its mounting to the plate 42. Since the cranking motor 50 is cantilever mounted, the engine, when in a running condition, will cause the cranking motor to oscillate generally in a vertical direction. This is caused by rotation of the crankshaft of the engine inducing some movement of the plate 42 which in turn causes the cranking motor 50 to oscillate as described. The oscillation of the cranking motor 50 will cause distortion of the head 14 of the bolt 10 with consequent distortion of the piezoelectric element 20. Accordingly, the piezoelectric element is distorted and stressed at the oscillation frequency of the cranking motor 50 and a signal, charge or voltage is accordingly developed at opposite sides of the piezoelectric element 20 which is detected and processed by the system illustrated in FIG. 4.

Figure 2:
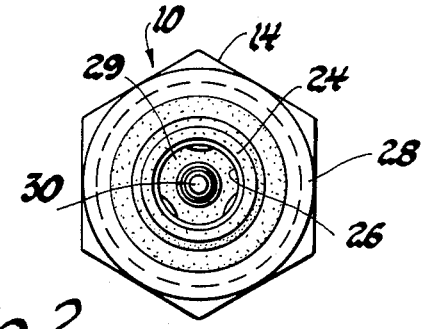
FIG. 2 is an end view of the bolt illustrated in FIG. 1.

Referring now more particularly to FIG. 4, an electrical system is illustrated for controlling the energization of the electric cranking motor 50 in response to an electric signal developed by the piezoelectric element 20. In FIG. 4 the same reference numerals have been utilized as were utilized in FIGS. 1–3 in order to identify corresponding elements.

In FIG. 4 the reference numeral 60 designates the direct voltage cranking motor which drives a shaft that in turn drives the pinion that at times becomes engaged with the ring gear 56. The solenoid 58 is comprised of a pull-in winding 58A and a hold-in winding 58B. The energization of these windings causes a plunger to shift which moves the pinion into mesh with the ring gear of the engine. This plunger is illustrated as a dotted line 70 in FIG. 4 and this plunger operates a shiftable electrical contact 72 that at times engages fixed electrical contacts 74 and 76. The pull-in and hold-in windings 58A and 58B are connected to a junction 78 which in turn is connected to a conductor 80. The opposite side of the pull-in winding 58A is connected to the direct voltage cranking motor 60 and to the fixed contact 76. The opposite side of hold-in winding 58B is connected to ground via junction 82 which is also connected to one side of the cranking motor 60. The fixed contact 74 is connected to a conductor 84 which in turn is connected to junction 86. A storage battery 88, for a motor vehicle that is propelled by the engine, has its positive terminal connected to junction 86 and has its negative terminal grounded. A manually operable start switch 90 is connected between the junction 86 and a junction 92.

The system of FIG. 4 utilizes a magnetic switch generally designated by reference numeral 94 that comprises a coil 94A, a movable contact 94B and fixed contacts 94C and 94D. When the coil 94A is energized the movable contact 94B is shifted into engagement with fixed contacts 94C and 94D to thereby electrically connect the positive terminal of battery 88 to the junction 78 which causes energization of the cranking motor.

Whenever the contact 94B engages the fixed contacts 94C and 94D, both the pull-in coil 58A and the hold-in coil 58B are energized thereby shifting the pinion of the cranking motor into engagement with the ring gear 56 and also causing the shiftable contact 72 to engage fixed contacts 74 and 76. When the movable contact 72 engages the fixed contacts 74 and 76 the direct voltage motor 60 is energized to thereby rotatably drive the pinion and in turn drive the ring gear 56 to crank the engine. When coil 94A is deenergized the movable contact 94B is shifted out of engagement with fixed contacts 94C and 94D by a spring, which is not illustrated, and this deenergizes the electric cranking motor. When the cranking motor is deenergized a spring (not illustrated) shifts the pinion out of mesh with the ring gear 56 and the movable contact 72 is shifted out of engagement with fixed contacts 74 and 76 in a manner well known to those skilled in the art.

The system of FIG. 4 utilizes an operational amplifier designated as A1 and a voltage comparator designated as A2. The amplifier and voltage comparator are part of a single package and may be, for example, a National Semiconductor type LM2924 Low Power Operational Amplifier/Voltage Comparator. The numerals adjacent the devices A1 and A2 are the terminal designations for a National Semiconductor type LM2924. The amplifier A1 operates as a charge converter or charge amplifier which responds to the charge or voltage developed by the piezoelectric element 20. The section A2 operates as a voltage comparator which compares the voltage at its positive and negative terminals.

The negative terminal of amplifier A1 is connected in series with one side of the piezoelectric element 20 via a circuit that includes a 2K ohm resistor 100, a 0.22 $\mu$f. capacitor 102, a 39 ohm resistor 104 and a conductor 106. The opposite side of piezoelectric element 20 is electrically grounded via head portion 14 of bolt 10. The conductor 106 is electrically connected to the terminal stud 30 and this conductor may have a metallic shield which is electrically grounded. In this regard it will be appreciated that the bolt 10 is grounded via its threaded connection with the metallic flange 42 of the engine and such a ground connection is illustrated in FIG. 4. The metallic part 26 of bolt 10 is also electrically grounded and it operates as an electrostatic shield. The output terminal of the amplifier A1 is connected to a conductor 108 and is also connected to junction 110 via a 2000 picofarad capacitor 112. In addition, conductor 108 is connected to junction 114 via a 22 megohm resistor 116.

The positive terminal of amplifier A1 is connected to a junction 118 located between a 51.1K ohm resistor 120 and a 36.5K ohm resistor 124. The resistors 120 and 124 are series connected between conductors 126 and 128. The conductor 128 is grounded while the conductor 126 is connected to junction 130. A 180 ohm resistor 132 connects the junctions 92 and 130. A Zener diode 134 is connected between conductor 126 and the grounded conductor 128. In a 12 volt system the Zener diode 134 may have a reverse breakdown voltage of approximately 10 volts and may be a type IN4740 Zener diode.

The output of amplifier A1, which is applied to conductor 108, is applied to a junction 140 via a 0.5 uf. capacitor 142. A voltage divider that includes the junction 140 is provided by resistors 144 and 146 that are series connected between conductor 126 and grounded conductor 128. The resistor 144 may have a resistance of approximately 51.1K ohms and resistor 146 may be approximately 39.2K ohms. Terminals 8 and 4 of the comparator A2 are connected respectively to junction 130 and grounded conductor 128 to provide power supply for comparator A2. Similar power supply connections are utilized for amplifier A1 which have not been illustrated. The output of comparator A2 is connected to a conductor 150. A resistor 152 of approximately 910 ohms connects the conductor 150 to a junction 154. A capacitor 156, of approximately 1 $\mu$f. is connected between junction 154 and the grounded conductor 128.

A PNP transistor 160 has its emitter connected to conductor 126 and has its collector connected to a junction 162 which in turn is connected to junction 154. A 1 megohm resistor 165 is connected between junctions 162 and 164 and therefore in parallel with the emitter-collector circuit of transistor 160. The base of transistor 160 is connected to a junction 166 via an 18K ohm resistor 168. The junction 166 is connected to a conductor 170 which in turn is connected to junction 172. A freewheeling diode 174 is connected between junctions 92 and 172 and therefore across the winding 94A of the magnetic switch 94.

The system of FIG. 4 utilizes a MOSFET transistor designated by reference numeral 180. The gate of this transistor is connected to junction 154 while the drain of this transistor is connected to junction 166. The source of transistor 180 is connected to a grounded conductor 182.

The operation of the cranking motor system illustrated in FIG. 4 will now be described. Assuming that the operator of a motor vehicle desires to crank the engine 40 the operator closes the manually operable switch 90. The closure of manually operable switch 90 completes a current path that can be traced from the positive terminal of battery 88, through the closed switch 90 to junction 92, through resistors 132 and 165 and through capacitor 156 to the grounded side of battery 88. This current path causes the capacitor 156 to be charged and thereby raises the potential at junction 154. At this time battery voltage is also applied to the voltage dividers comprised respectively by resistors 144 and 146 and 120 and 124. The relative voltages at junction 118 and 140 are now such that voltage at junction 140 exceeds the voltage at junction 118 and accordingly the voltage at the positive input terminal of A2 exceeds the voltage at the negative input terminal of A2. The comparator A2 has an NPN output transistor the collector of which is connected to output terminal 1 and the emitter of which is connected to terminal 4. When the voltage at the positive input terminal 3 of A2 is lower than the voltage at the negative terminal 2 of A2 the transistor is biased conductive to connect terminals 1 and 4 of comparator A2. When the voltage at the positive input terminal 3 of A2 exceeds the voltage at the negative terminal 2 of A2 the transistor is biased nonconductive to provide a substantially open circuit between terminals 1 and 4 of comparator A2. As previously mentioned, when switch 90 is initially closed, the voltage at the positive input terminal of A2 exceeds the voltage at the negative input terminal of A2 with the result that the comparator A2 provides a substantially open circuit between conductor 150 and ground with the result that the output transistor of comparator A2 does not shunt charging current away from capacitor 156. When the voltage developed across capacitor 156 reaches a predetermined level the voltage of the gate of transistor 180 is raised sufficiently to cause the transistor 180 to conduct between its drain and source.

When transistor 180 is biased conductive it completes a circuit for the energization of the coil 94A of magnetic switch 94 and the movable contact 94B is shifted into engagement with fixed contacts 94C and 94D. This causes the cranking motor to be energized, in a manner previously described, which causes the pinion of the cranking motor to become meshed with the ring gear 56 of the engine. The cranking motor 60 is energized to therefore cause the engine to be cranked. When transistor 180 is biased conductive it also completes a circuit for base current of transistor 160 that can be traced from junction 164, through the emitter-base circuit of transistor 160, through resistor 168, to junction 166 and through the conductive transistor 180 to ground. The flow of base current in transistor 160 causes this transistor to conduct in its emitter-collector circuit with the result that the positive voltage at junction 130 is applied to the gate of transistor 180 through the emitter-collector circuit of transistor 160. As a result of the turning on of transistors 180 and 160 the transistor 180 is latched conductive. Thus, regardless of the switching condition of comparator A2, the transistor 180 will remain biased conductive to maintain engine cranking as long as the switch 90 is closed.

When the engine is being cranked by the cranking motor the crankshaft thereof is rotated causing the cranking motor to oscillate and further causing an alternating voltage or charge to be developed by the piezoelectric element 20. This AC voltage is amplified by amplifier A1 and the voltage at the positive terminal (terminal 3) of comparator A2 varies to cause the comparator to switch between two conditions. Thus, the alternating output voltage of amplifier A1 is applied to the positive terminal 3 of comparator A2 and is superimposed on the direct voltage applied to positive input terminal 3 from voltage divider junction 140. This alternating voltage causes the voltage at input terminal 3 of comparator A2 to vary such that it goes higher and lower than the voltage of the negative input terminal 2 of comparator A2 with the result that the output transistor of comparator A2 is switched between two conditions. In one of these conditions the output of comparator A2 presents a substantially open circuit between terminals 1 and 4 of this comparator, as previously described. In another condition of operation the comparator A2 electrically connects its terminals 1 and 4 to thereby electrically connect the conductor 150 to ground, in a manner previously described. As the comparator A2 switches between a conductive and open circuit condition the system tries to charge and discharge capacitor 156 at the rate of oscillation of the cranking motor but the transistor 180 now remains conductive due to the latching mode of operation that has been previously described. Putting it another way, the voltage at junction 154 remains high enough to maintain transistor 180 biased conductive since the high valued resistor 165 is now bypassed by the conducting transistor 160. Therefore, during an initial cranking mode of the engine the flexure of the piezoelectric element 20, due to oscillation of the cranking motor, will not terminate the cranking mode of operation.

When the engine starts, the operator of the motor vehicle opens the switch 90 thereby removing the application of voltage to junction 92. Any charge accumulated by capacitor 156 will be dissipated through the one megohm resistor 165 and the voltage divider resistors 120, 124 and 144 and 146. With the engine running, the piezoelectric element 20 generates a charge or voltage in response to oscillation of the cranking motor but since no voltage is applied to the circuit, because the switch 90 is open, the circuit is quiescent.

Assuming that the engine is running and that the piezoelectric element 20 is being stressed, to develop a charge or voltage, the closure of switch 90, in an attempt to energize the cranking motor, will not result in energizing the cranking motor. Thus, if the switch 90 is closed the capacitor 156 will be charged when comparator A2 is in the condition of operation, presenting an open circuit between terminals 1 and 4 thereof through relatively high valued resistor 165 (1 megohm) but the capacitor will immediately discharge through relatively low valued resistor 152 (910 ohms) and terminals 1 and 4 of comparator A2 when it switches to a state electrically connecting terminals 1 and 4. The oscillation of the cranking motor, and consequently the frequency of the voltage developed by the piezoelectric element 20 and accordingly the switching frequency of comparator A2, is such that the capacitor 156 will never attain a sufficient voltage to bias transistor 180 conductive. Accordingly, the cranking motor will never be energized since the voltage developed by the piezoelectric element 20, in response to a running condition of the engine, prevents conduction of transistor 180 and therefore prevents energization of the cranking motor.

The system of this invention is applicable to diesel and spark ignited engines. The system responds to a running condition of the engine, as well as to coasting conditions of the engine in which the engine is not powered. The system will also respond to so-called dieseling of a spark ignited engine where the engine continues to run after ignition power is removed. The system will also respond to a so-called rock-back of the crankshaft of the engine, where the engine is coasting to a stop, and in general the system responds to any rotation of the engine crankshaft that is sufficient to cause the piezoelectric element 20 to be stressed to thereby cause a voltage to be generated therein.

In describing this invention specific values have been given for the circuit elements of FIG. 4. These values are for a 12 volt system and can be varied as long as the system performs its intended function.

As mentioned, the part 29 serves as a resistor and it is electrically connected in parallel with the piezoelectric element 20. The purpose of this resistor is to prevent any excessive charge from building up across the element 20 that might be caused, for example, by temperature changes that might cause distortion of the element 20. Excessive charge could cause the piezoelectric element to fail and the resistor prevents this. The resistor can perform this function as soon as the bolt 10 is completely assembled.

The number of mounting bolts for securing the cranking motor 50 to engine 40 will vary, depending upon the type of cranking motor utilized for a particular engine application. Regardless of the number of bolts that are used one of them will be of the type illustrated in FIGS. 1 and 2 that has a piezoelectric transducer.

The embodiments of the invention in which an exclusive property or privilege is claimed are defined as follows:

1. Apparatus for developing an electrical signal in response to a running condition of an internal combustion engine comprising in combination, an internal combustion engine having a housing, a cranking motor for cranking said engine having a mounting housing portion engaging a portion of said engine housing, at least one bolt having a head portion engaging said cranking motor housing portion and having a threaded portion threaded into a threaded opening in said engine housing for securing said cranking motor to said engine, said head portion of said bolt carrying a transducer that is operative to translate mechanical movement of the head portion into an electrical signal, said head portion of said bolt being mechanically moved by oscillatory motion of said cranking motor caused by a running condition of said engine to thereby cause said transducer to produce an electrical signal.

2. Apparatus for developing an electrical signal in response to a running condition of an internal combustion engine comprising in combination, an internal combustion engine having a housing, a cranking motor for cranking said engine having a mounting housing portion engaging a portion of said engine housing, at least one bolt having a head portion engaging said cranking motor housing portion and having a threaded portion threaded into a threaded opening in said engine housing for securing said cranking motor to said engine, said head portion of said bolt carrying a piezoelectric element that is operative to translate mechanical movement of the head portion into an electrical signal, said head portion of said bolt being mechanically moved by oscillatory motion of said cranking motor caused by a running condition of said engine to thereby stress said piezoelectric element to produce an electrical signal.

3. Apparatus for developing an electrical signal in response to a running condition of an internal combustion engine comprising in combination, an internal combustion engine having a housing, a cranking motor for cranking said engine having a mounting housing portion located adjacent one end thereof engaging a portion of said engine housing, a plurality of bolts each having a head portion engaging said cranking motor housing portion and each having a threaded portion threaded into a threaded opening in said engine housing for securing said cranking motor to said engine, said cranking motor extending axially of said portion of said engine housing such that the cranking motor is cantilever mounted to said engine, the head portion of at least one of said bolts carrying a transducer that is operative to translate mechanical movement of the head portion into an electrical signal, said head portion of said bolt being mechanically moved in response to oscillatory motion of said cranking motor caused by a running condition of said engine to thereby cause said transducer to produce an electrical signal.

4. An electric cranking motor control system comprising, an electric cranking motor, an internal combustion engine, means fastening said cranking motor to said engine in a cantilever mounting comprising a bolt having a head portion, said head portion carrying a transducer that is stressed to produce a signal in response to oscillatory motion of said cranking motor caused by a running condition of said engine, a source of voltage, means including manually operable switch means for causing said cranking motor to be energized from said source of voltage, and means for at times preventing energization of said cranking motor from said voltage source when said transducer is developing said signal.

5. An electric cranking motor control system comprising, an electric cranking motor, an internal combustion engine, means fastening said cranking motor to said engine in a cantilever mounting comprising a bolt having a head portion, said head portion carrying a piezoelectric element that is stressed to produce a signal in response to oscillatory motion of said cranking motor caused by a running condition of said engine, a source of voltage, means including manually operable switch means for causing said cranking motor to be energized from said source of voltage, and means for at times preventing energization of said cranking motor from said voltage source when said piezoelectric element is developing said signal.

6. An electric cranking motor control system comprising, an electric cranking motor, an internal combustion engine, means fastening said cranking motor to said engine comprising a bolt having a head portion, said head portion carrying a transducer that is stressed to produce a signal in response to a running condition of said engine and is stressed to produce said signal when said engine is being cranked by said cranking motor, a source of voltage, means including manually operable switch means for causing said cranking motor to be energized from said source of voltage, control means for at times preventing energization of said cranking motor from said voltage source when said transducer is developing said signal, and circuit means responsive to initial closure of said manually operable switch means for preventing operation of said control means when said engine is being initially cranked by said cranking motor.

7. An electric cranking motor control system comprising, an electric cranking motor operative when energized to crank an internal combustion engine, a source of voltage, means comprising a semiconductor switch means operative when conductive to cause said cranking motor to be energized and operative when nonconductive to cause said cranking motor to be deenergized, a capacitor directly connected to a control electrode of said semiconductor switch means, said semiconductor switch means being biased conductive when said capacitor is charged to a predetermined voltage, a piezoelectric element mechanically coupled to said engine developing a signal in response to a running condition of said engine, means for at times repetitively charging and discharging said capacitor when said signal is developed at such a rate that the voltage attained by said capacitor does not reach a level sufficient to bias said semiconductor switch means conductive whereby said cranking motor is prevented from being energized when said engine is running, a manually operable start switch, and means responsive to initial closure of said start switch for charging said capacitor to a voltage level sufficient to bias said semiconductor switch means conductive and for maintaining said semiconductor switch means conductive as long as said start switch is closed.

* * * * *